US008881432B1

(12) United States Patent
German et al.

(10) Patent No.: US 8,881,432 B1
(45) Date of Patent: Nov. 11, 2014

(54) DITCH-CLEANING DEVICE

(76) Inventors: Edward German, Dillon, SC (US); Willie Bethea, Dillon, SC (US)

( * ) Notice: Subject to any disclaimer, the term of this patent is extended or adjusted under 35 U.S.C. 154(b) by 446 days.

(21) Appl. No.: 13/225,612

(22) Filed: Sep. 6, 2011

(51) Int. Cl.
*E02F 9/08* (2006.01)

(52) U.S. Cl.
USPC ..... 37/92

(58) Field of Classification Search
CPC ..... E02F 3/18; E02F 3/20; E02F 3/26; E02F 3/183; E02F 3/186; E02F 5/027; E02F 5/06; E02F 7/02; E02F 5/08; E02F 5/145; E02F 5/282; E02F 9/0808; A01D 34/435; A01D 34/44; A01D 34/86
USPC ..... 37/91, 92, 93, 105, 302, 365, 352, 366, 37/95, 189; 172/284, 817, 149, 823, 554; 171/65; 414/451, 688, 718
See application file for complete search history.

(56) References Cited

U.S. PATENT DOCUMENTS 2,786,284 A * 3/1957 Todd ..... 37/350
3,261,117 A * 7/1966 Shoemaker et al. ..... 37/92
3,624,826 A * 11/1971 Rogers ..... 37/92
3,704,575 A * 12/1972 Daniel et al. ..... 56/12.7
D237,293 S * 10/1975 Ruhl ..... D15/32
4,109,336 A * 8/1978 Ford ..... 15/3
4,572,258 A * 2/1986 Mischel ..... 144/208.7
4,872,275 A * 10/1989 Beckett et al. ..... 37/91
5,027,534 A * 7/1991 Sackett ..... 37/91
5,199,195 A * 4/1993 Scordilis et al. ..... 37/350
5,511,326 A * 4/1996 Liebrecht, Jr. ..... 37/93
6,336,280 B1 * 1/2002 Haigh ..... 37/92
6,418,647 B1 * 7/2002 Erickson ..... 37/366
6,435,766 B1 * 8/2002 Titford ..... 404/75
7,549,483 B2 * 6/2009 Plessala, Jr. ..... 172/554

* cited by examiner

*Primary Examiner* — Robert Pezzuto

(57) ABSTRACT

The ditch-cleaning device is an accessory for a continuous track machinery that is either dragged along or driven forwardly via the machinery in order to clear out and forcibly throw undergrowth from a ditch or depressed surface. The accessory is constructed of a drum upon which a plurality of scoops and digger teeth adorn specific regions along an exterior and of which strip and subsequently throw said undergrowth. The drum is rotated while the machinery moves along a ditch or depressed surface such that the digger teeth strip said undergrowth, and subsequently the scoops forcibly throw said undergrowth away from the ditch or depressed surface. A protective cover may be included with and cover a top half of said drum so as to prevent debris from being thrown from said device.

6 Claims, 4 Drawing Sheets

DITCH-CLEANING DEVICE

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of heavy equipment accessories, more specifically, a rotating drum that is specifically suited for cleaning out a ditch of undergrowth.

Ditches alongside a parcel of land or a road can accumulate undergrowth comprising weeds and reeds. This undergrowth can be a dilemma where the ditch is specifically created to provide drainage immediately adjacent a road. The existence of said undergrowth can prevent adequate drainage, and can result in slippery conditions. That being the case, there is a need for a device that can strip a depressed surface or ditch of undergrowth. More importantly, there is a need to provide a device that can be driven along side said ditch or depressed surface, which upon use will clear out and throw by force the undergrowth out and away from said ditch.

The device disclosed below meets the needs of a device that can clear out undergrowth from a ditch or depressed surface.

B. Discussion of the Prior Art

As will be discussed immediately below, no prior art discloses an accessory for a continuous track machinery that is comprised of a drum upon which a plurality of teeth and scoops extend radially away from an exterior surface and of which is rotatably engaged at a downward angle with respect to the plane of travel of said machinery; wherein as the accessory is rotatably driven along, the teeth and scoops are specifically suited for clearing and forcibly removing undergrowth and engaging the top surface of dirt along a ditch whereas said machinery straddles over said ditch or along side.

The Beckett et al. patent (U.S. Pat. No. 4,872,275) discloses a ditch cleaning machine having a pair of rotors. However, the machine is not a drum that is rotated about a rotating means mounted to a continuous track machine.

The Plessala, Jr. patent (U.S. Pat. No. 7,549,483) discloses a furrow/ditch clearer having a rotating wheel with elongated blades that contact obstructing matter. Again, the ditch clearer is not a rotating drum on which digger teeth and scoops spin to clear out undergrowth from a ditch.

The Daniel et al. patent (U.S. Pat. No. 3,704,575) discloses a ditch cleaning device comprising a chain rotating mechanism. However, the rotating chains are flung to clear undergrowth as opposed to a rotating drum having a plurality of digger teeth and scoops.

The Rogers patent (U.S. Pat. No. 3,624,826) discloses a ditch cleaning device comprising a rotor that is driven by the power take off adapter of a tractor. Again, the device is not a rotating drum that attaches to a continuous track machine and of which rotates via a rotating means to impact undergrowth of a ditch via digger teeth and subsequently throw said cut undergrowth via scoops.

The Ford patent (U.S. Pat. No. 4,109,336) discloses an automated machine for cleaning debris from roadside ditches. However, the automated machine does not rely upon a rotating drum that clears undergrowth when driven alongside a ditch.

While the above-described devices fulfill their respective and particular objects and requirements, they do not describe an accessory for a continuous track machinery that is comprised of a drum upon which a plurality of teeth and scoops extend radially away from an exterior surface and of which is rotatably engaged at a downward angle with respect to the plane of travel of said machinery; wherein as the accessory is rotatably driven along, the teeth and scoops are specifically suited for clearing and forcibly removing undergrowth along a ditch whereas said machinery straddles over said ditch or along side. In this regard, the ditch-cleaning device departs from the conventional concepts and designs of the prior art.

SUMMARY OF THE INVENTION

The ditch-cleaning device is an accessory for a continuous track machinery that is either dragged along or driven forwardly via the machinery in order to clear out and forcibly throw undergrowth from a ditch or depressed surface. The accessory is constructed of a drum upon which a plurality of scoops and digger teeth adorn specific regions along an exterior and of which strip and subsequently throw said undergrowth. The drum is rotated while the machinery moves along a ditch or depressed surface such that the digger teeth strip said undergrowth; and subsequently the scoops forcibly throw said undergrowth away from the ditch or depressed surface. A protective cover may be included with and cover a top half of said drum so as to prevent debris from being thrown from said device.

An object of the invention is to provide a device that can clear and remove undergrowth from a ditch or depressed surface.

A further object of the invention is to provide an accessory for a continuous track machinery that can be dragged behind or driven forward.

A further object of the invention is to provide a device that rotates a drum and of which strips and clears undergrowth from the ditch or depressed surface.

A further object of the invention is to provide a device that is angled downwardly with respect to the plane of travel of the continuous track machinery.

A further object of the invention is to provide a drum with a plurality of digger teeth that are spaced along a first portion of the drum and of which engages undergrowth first.

An even further object of the invention is to provide the drum with a plurality of scoops that are spaced along a second portion of the drum and of which subsequently forcibly throws the cleared undergrowth up and away from the ditch or depressed surface.

A further object of the invention is to include a cover that extends across a top half of the device, which prevents debris from being thrown upwardly and away from the device.

These together with additional objects, features and advantages of the ditch-cleaning device will be readily apparent to those of ordinary skill in the art upon reading the following detailed description of presently preferred, but nonetheless illustrative, embodiments of the ditch-cleaning device when taken in conjunction with the accompanying drawings.

In this respect, before explaining the current embodiments of the ditch-cleaning device in detail, it is to be understood that the ditch-cleaning device is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the ditch-cleaning device.

It is therefore important that the claims be regarded as including such equivalent construction insofar as they do not depart from the spirit and scope of the ditch-cleaning device. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
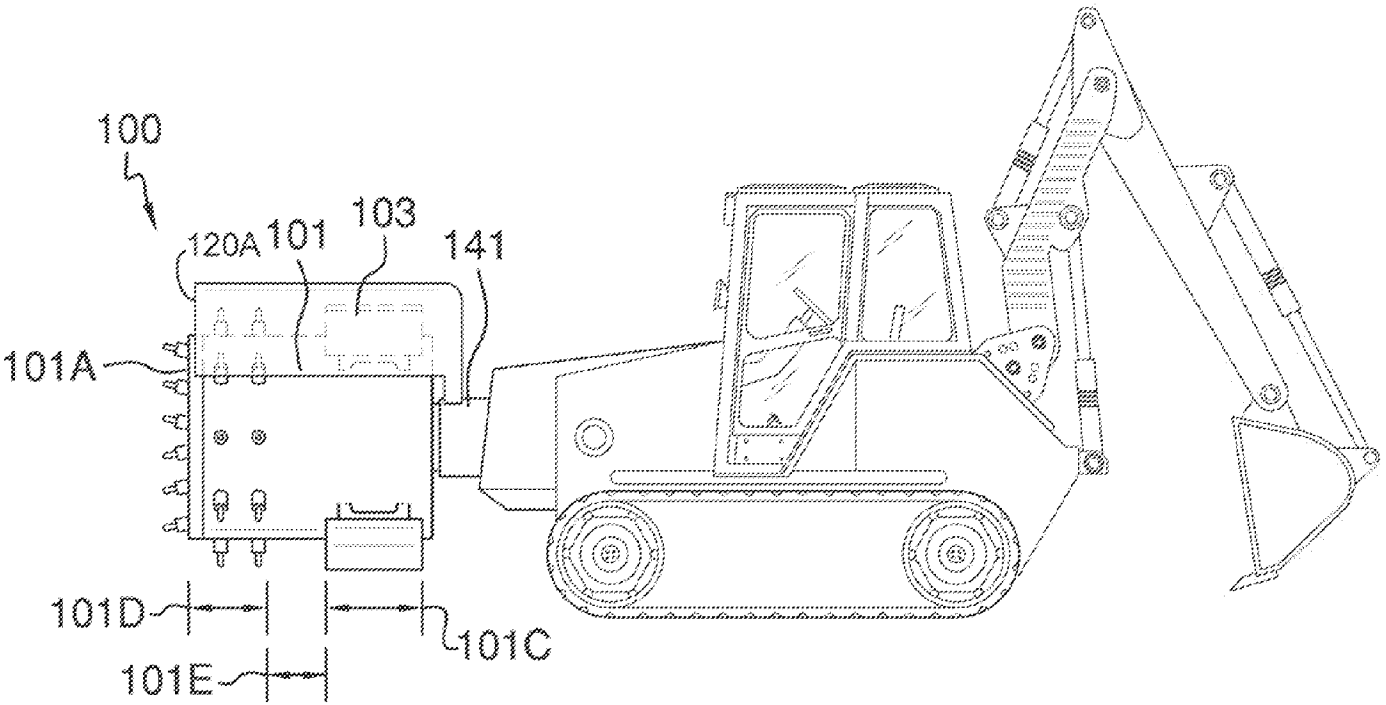
FIG. 1 illustrates a side view of the ditch-cleaning device installed onto a continuous track machinery and is parallelably aligned with the plane of travel of said machinery and is depicted in broken lines being partially covered along a top portion of the device.
Figure 2:
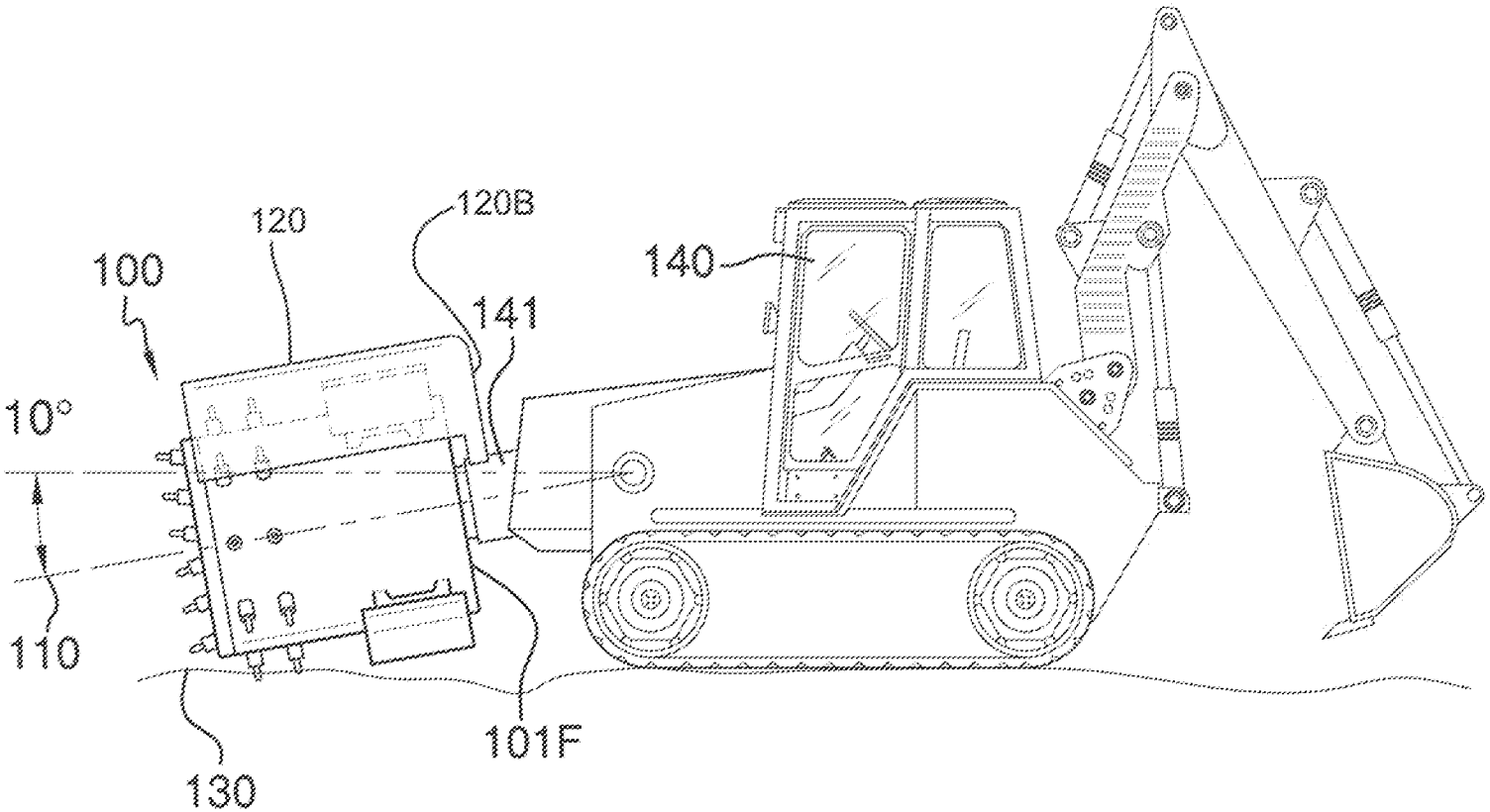
FIG. 2 illustrates a side view of the ditch-cleaning device in which the accessory is lowered at a downward angle with respect to the plane of travel so as to engage the surface of a ditch or depressed surface.
Figure 3:
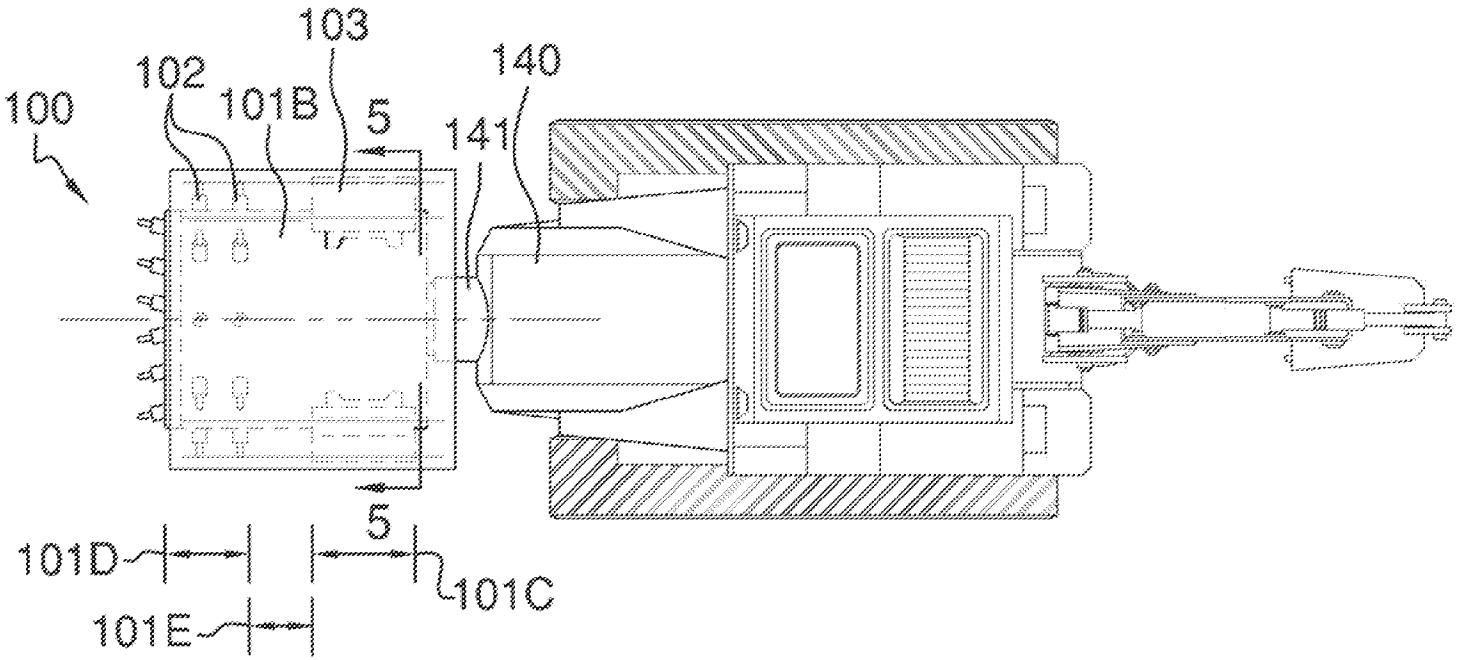
FIG. 3 illustrates a top view of the ditch-cleaning device in which the cover encases the device from all sides above said device.
Figure 4:
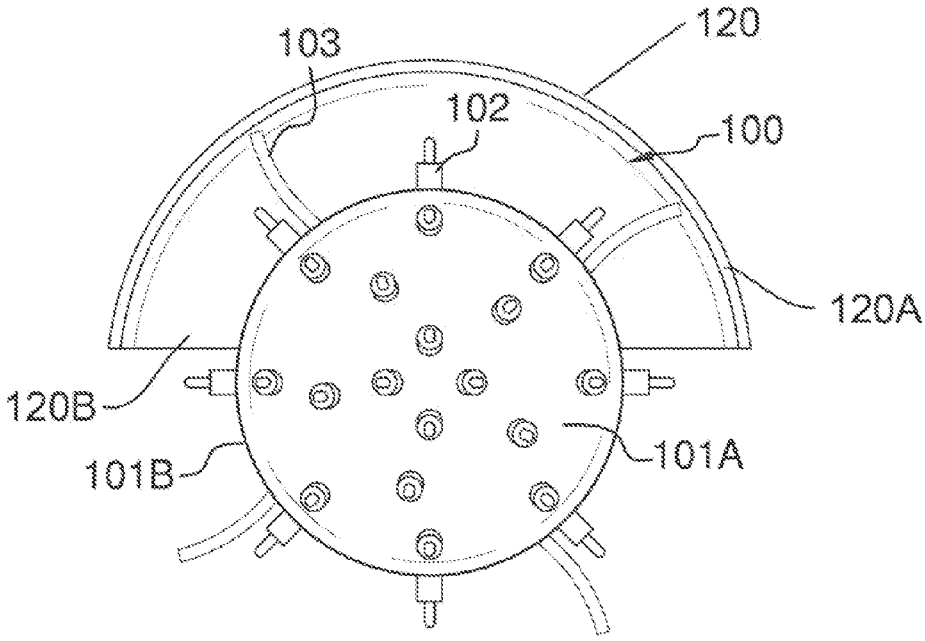
FIG. 4 illustrates a front view of the ditch-cleaning device in which detail is provided as to the range of coverage offered by the cover.
Figure 5:
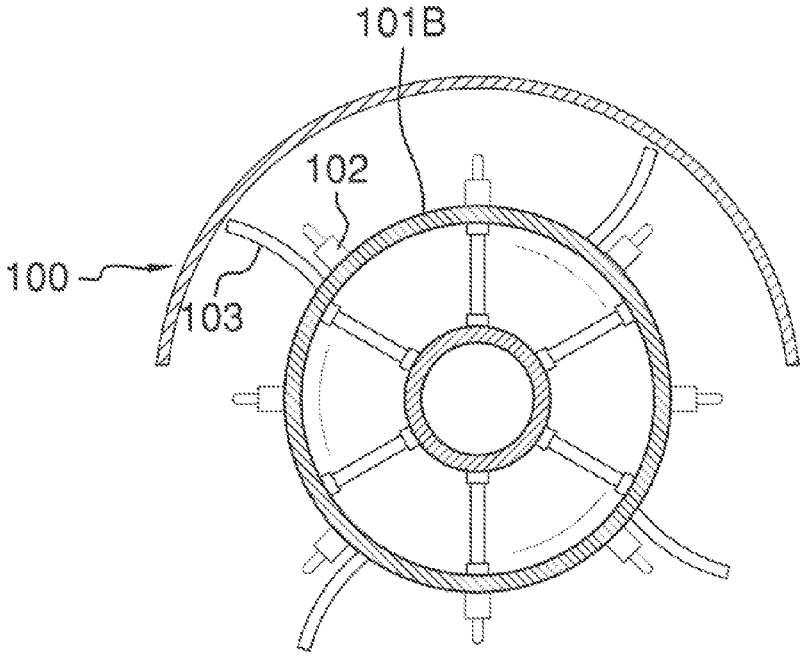
FIG. 5 illustrates a cross-sectional view of the ditch-cleaning device along line 5-5 in FIG. 3 and detailing the construction of the drum as well as the spatial relationship with the cover.

Detailed reference will now be made to the preferred embodiment of the present invention, examples of which are illustrated in FIGS. 1-5. A ditch-cleaning device 100 (hereinafter invention) includes a drum 101 of hollow construction. The drum 101 is further defined with an exterior composed of a front surface 101A and a cylindrical surface 1018. The drum 101 shall be made of a material comprising a metal having a thickness of not less than ¼ inch to not more than 3 inches. The drum 101 shall be a cylinder of a length of not less than 2 feet to not more than 10 feet, and a diameter of not less than 1 foot to not more than four feet.

Adorning the front surface 101A and a portion of the cylindrical surface 101B is a plurality of digger teeth 102. Adorning a portion of the cylindrical surface 101B is a plurality of scoops 103. It shall be noted that the cylindrical surface 101B may be further divided into an inner region 101C in which the scoops 103 is located, and a separate outer region 101E in which the digger teeth 102 are located.

It shall be further noted that the digger teeth 102 are sporadically distributed on the front surface 101A and the outer region 101E of the cylindrical surface 101B. More particularly, it shall be noted that the outer region 101E of the cylindrical surface 101B is adjacent the front surface 101A. The inner region 101C of the cylindrical surface 101B is farthest from the front surface 101.

The digger teeth 102 are designed to clear, shred, and detach undergrowth with a ground 130. Furthermore, it shall be noted that the digger teeth 102 are made of a hard material such as tool grade steel, and is also capable of removing dirt when engaging the ground 130. The digger teeth 102 shall be cylindrical protuberances that extend at least one inch to not more than 10 inches from the surface of the drum, and of which is suitably designed to engage undergrowth and shred/teat/detach said undergrowth from the ground 130.

It shall be noted that the ground 130 is being referred to as an uneven surface that can be covered in undergrowth, and of which may involve surfaces of a ditch or a depressed ground surface.

Once the undergrowth is detached from the ground 130 via the digger teeth 102, the scoops 103 will lift and forcibly hurl said undergrowth up and away from the ground 130. It shall be noted that the action of the scoop 103 is premised on the movement of the invention 100 across the ground in a linear and undefined distance. A middle region 101D exists between the inner region 101C and an outer region 101E and separates the digger teeth 102 from the scoops 103. The middle region 101D is designed to provide an amount of time to elapse between action by the digger teeth 102 and the scoops 103, which enables the undergrowth and loosened dirt to separate from the digger teeth 102 and drop back towards the ground 130.

The scoops 103 are composed of curved pieces that are aligned down the length of the drum 101. The curved pieces of the scoops 103 are concentrically-aligned along the exterior of the drum 101, and are suited for collecting detached undergrowth and hurling said undergrowth up and away to a side of the ground 130 being worked by the drum 101.

The invention 100 is designed to be an accessory attached to a continuous track machine 140. Furthermore, the invention 100 is rotated with respect to the continuous track machine 140 via a rotating means 141 that is installed on the continuous track machine 140. The rotating means 141 shall be able to rotate the drum 101 either clockwise or counterclockwise and at a rotational speed ranging from zero to 200 revolutions per minute.

The rotating means 141 attaches to a, rear end 101E of the drum 101, and is responsible for attachment of the invention 100 onto the continuous track machine 140. The rotating means 141 may be in the form of an engine (not shown) in mechanical communication with a gear reducer in order to rotate the drum 101; or in the alternative a hydraulic pump that rotates the drum thereon, and of which is well known in the field of heavy equipment.

It is important that the rotating means 141 can rotate the drum 101 at varying speeds and to very direction in order to address different sides of the ground 130 as well as varying thicknesses of undergrowth. Naturally, it is desirable to increase the rotational velocity of the drum 101 when engaging thick undergrowth so as to impart the inertial force generated by the weight of the drum 101 in order to overcome the force required to detach the undergrowth.

The invention 100 is designed to be positioned at a downward angle 110 that can range from 0 degrees to 30 degrees. The downward angle 110 enables the invention 100 to have greater access of the ground 130.

It shall be noted that the rotating means 141 may be responsible for raising or lowering the drum 101, and thus be responsible for the downward angle 110.

The invention 100 includes a cover 120 that is aligned above the drum 101, and which covers a portion of the drum 101 from above. The cover 120 is provided as a means of preventing debris from flying upwardly and away from the invention 100, and is designed to be a safety feature when the invention 100 is in use. The cover 120 has a curvature that coincides with the drum 101, and provides clearance with the digger teeth 102 and the scoops 103.

The cover 120 is open along a front edge 120A, but is partially closed along a rear edge 120B. The cover 120 is affixed to the rotating means 141. The cover 120 does not rotate, but remains stationary with respect to the drum 101.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

We claim:

1. A ditch-cleaning device comprising:

a drum upon which a plurality of digger teeth and scoops extend;

wherein the drum is rotatably attached to a continuous track machine and driven along a ditch or depressed ground surface in order to adaptively detach and hurl undergrowth there from;

wherein the drum is further defined by a front surface and a cylindrical surface;

wherein the cylindrical surface is further defined by an outer region, middle region, and inner region;

wherein the digger teeth are located on the front surface and the outer region of the cylindrical surface;

wherein the scoops are located on the inner region of the cylindrical surface;

wherein the digger teeth are cylindrical protuberances that extend at least one inch to not more than 10 inches from the surface of the drum;

wherein the middle region exists between the inner region and the outer region and separates the digger teeth from the scoops; wherein the middle region enables an amount of time to elapse between action by the digger teeth and the scoops, which adaptively enables the undergrowth to separate from the digger teeth and drop back towards the ground;

wherein the scoops are composed of curved pieces that are aligned down the length of the drum; the curved pieces of the scoops are concentrically-aligned along the exterior of the drum, and are suited for collecting detached undergrowth and hurling said undergrowth up and away to a side of the ground being worked by the drum;

wherein the drum is rotated with respect to the continuous track machine via a rotating means that is installed on the continuous track machine; wherein the rotating means can rotate the drum either clockwise or counterclockwise.

2. The ditch-cleaning device as described in claim 1 wherein the drum shall be made of a material having a thickness of not less than ¼ inch to not more than 3 inches; wherein the drum shall be a cylinder of a length of not less than 2 feet to not more than 10 feet, and a diameter of not less than 1 foot to not more than four feet.

3. The ditch-cleaning device as described in claim 1 wherein a rotating means rotates the drum at a rotational speed ranging from zero to 200 revolutions per minute.

4. The ditch-cleaning device as described in claim 3 wherein the rotating means can position the drum at a downward angle ranging from 0 degrees to 30 degrees.

5. The ditch-cleaning device as described in claim 4 wherein a cover is aligned above and covers a portion of the drum; wherein the cover attaches to and extends from the rotating means; wherein the cover remains stationary with respect to the drum.

6. The ditch-cleaning device as described in claim 5 wherein the cover is open along a front edge, but is partially closed along a rear edge.

* * * * *